United States Patent [19]

Chow

[11] Patent Number: 4,497,441

[45] Date of Patent: Feb. 5, 1985

[54] PULSATING SPRINKLER

[75] Inventor: Ho Chow, River Edge, N.J.

[73] Assignee: Melnor Industries, Inc., Moonachie, N.J.

[21] Appl. No.: 488,203

[22] Filed: Apr. 25, 1983

[51] Int. Cl.[3] ..... B05B 03/14

[52] U.S. Cl. ..... 239/230

[58] Field of Search ..... 239/230, 231, 233

[56] References Cited

U.S. PATENT DOCUMENTS

| | | | |
|---|---|---|---|
| 2,625,411 | 1/1953 | Unger | 239/233 X |
| 2,904,261 | 9/1959 | Johnson | 239/230 |
| 2,928,608 | 3/1960 | Royer | 239/230 |
| 3,009,650 | 11/1961 | Alvarez | 239/233 X |
| 3,350,015 | 10/1967 | Friedmann et al. | 239/230 |
| 4,182,494 | 1/1980 | Wichman et al. | 239/230 |
| 4,402,460 | 9/1983 | Shavit et al. | 239/230 |

*Primary Examiner*—John J. Love

*Attorney, Agent, or Firm*—James & Franklin

[57] ABSTRACT

A pulsating sprinkler utilizes an improved method of anchoring the helical torsion spring at one end to the sprinkler body and at the other end to the impact arm to facilitate the assembly process and provide a more reliable and uniform spring action. A radially ridged member adapted for connection to a fluid source carries a pair of sector stops, each extending totally about a circumference thereof and having a single tab enabling rotation of the sector stop in both directions. When employed as a full circle sprinkler, the sprinkler automatically corrects the direction of rotation of the sprinkler body in the event that it initially rotates in the wrong direction.

7 Claims, 11 Drawing Figures

PULSATING SPRINKLER

BACKGROUND OF THE INVENTION

The present invention relates to water sprinklers, and, more particularly, to water sprinklers which utilize an oscillating mechanism driven by the jet of water which issues from the sprinkler.

Step-by-step rotary or pulsating sprinklers of the impact type employ an impact arm mounted for oscillating movement about a vertical axis. The impact arm includes a drive spoon, which in an impact limiting position is disposed in a position to be engaged by the fluid stream issuing from the outlet nozzle of the sprinkler. The drive spoon includes an initial pull-in surface which engages the stream and, by virtue of such engagement, creates a reaction component in a direction to move the drive spoon further into the stream and away from the impact limiting position. The initial pull-in surface of the drive spoon serves to direct the stream engaging the same on to a spaced reactant surface which establishes a reactant force outwardly of the axis having a tangential component capable of effecting movement of the impact arm in a direction away from the impact limiting position. As the impact arm moves away, a helical torsion spring acting between the impact arm and the sprinkler body serves to retard the movement and effect a return movement of the impact arm to the impact-limiting position. When the impact arm reaches the impact limiting position with the drive spoon back in the stream, the arm impacts the rotatable sprinkler body so as to impart an arcuate movement to the sprinkler body mounted upright on the pivotal axis. In this way a relatively slow arcuate step-by-step movement is automatically cyclically imparted to the sprinkler body.

The helical torsion spring typically used for this purpose has its ends secured to the cooperating parts (that is, either the impact arm or the sprinkler body, depending upon the end) by threading the end through one or more apertures provided in the cooperating part and finally bending the tip about the cooperating part in such a manner as to preclude retreat of the spring end from the apertures through which it passed. As the spring ends must be bent during the assembly process, this procedure increases the cost of such assembly process. Furthermore, where the tips are bent either too far, so there is a tendency for the tip to break off in use, or not far enough, so the tip does not block passage through the apertures, retreat of the spring ends from the apertures is possible. Even where the spring tips are properly bent, the apertures through which the spring ends must pass are typically disposed in the cooperating parts so that the normal helical pattern of the spring is greatly deformed, especially the last turn or so at each end. See, for example, U.S. Pat. No. 3,977,610. This loss of uniformity in the disposition of the helical torsion spring is not only an aesthetic detraction, but more importantly introduces non-uniformities into the force with which the spring forces the impact arm against the sprinkler body at the impact limiting position, and, in extreme cases, can develop weakness in the spring after repeated use. Accordingly, the need remains for a sprinkler which utilizes a helical torsion spring having preformed ends which are easily engaged with the cooperating parts of the sprinkler during the assembly process by unskilled labor without further bending and without substantial distortion of the regular helical pattern of the torsion spring.

The trip mechanism used to automatically reverse the direction of rotation of a partial circle pulsating sprinkler typically includes latch means for interacting with the impact arm, trigger means for interacting with the sector stops (defining the limits of rotation) and a trip spring connecting the latch and trigger means. The ends of the trip spring are typically secured, one end to the latch means and one end to the trigger means, by bending of the spring ends during the assembly process or by the use of external fastening devices. The bending during the assembly process introduces many of the same problems involved with the bending of the helical torsion spring during the assembly process, while the use of external fasteners add to the manufacturing costs as well as requiring additional steps in the assembly process. Accordingly, the need remains for a sprinkler having a trip spring with pre-bent ends adapted for ready engagement with the cooperating parts during the assembly process without the need for further bending of the trip spring ends and without the need for any external fasteners.

In partial circle sprinklers, the bushing-mounted sector stops used to define the limits of rotation typically do not totally extend around a circumference of the bushing. Where the sector stop is made of strongly resilient material, such as metal, and the circumferential portion of the bushing is smooth, a single radially extending tab can be provided on the sector stop as the sector stop can be rotated usually only in one direction by pushing the tab. The friction between the bushing and the sector stop suffice to hinder unintended sector stop rotation. On the other hand, where the sector stop is formed of a less resilient material, such as plastic, the bushing member typically includes a circumferential portion defining radially projecting ridges and each of the sector stops has adjacent each end thereof a radially inwardly projecting lug adapted for meshing engagement with the bushing ridges to preclude sector stop rotation in both directions. Pressure against one of the sector stop ends releases the associated lug from engagement with the bushing ridges and permits the rotation of the sector stop in a first direction (but not a second), while pressure against the other sector stop end releases the associated lug from engagement with the bushing ridges and permits rotation of the sector stop in the second direction (but not the first). Thus, in order to fine tune the positioning of a sector stop, the user may have to resort to grasping in turn one end, then the other, of the sector stop. Thus the need remains for a plastic sector stop useful with such a ridged bushing, but having a single tab by means of which one may rotate the sector stop in either direction. The single tabs facilitate accurate setting of the desired arc between tabs, avoiding the confusion inherent in the use of four sector stop ends.

In a partial circle pulsating sprinkler, the sprinkler slowly rotates in a step-by-step mode through the desired arc of rotation defined by the sector stops, the slowness of the rotation enabling the full potential range of the spray to be achieved. When the trigger means of the trip means encounters the sector stop at the end of the arc, the trigger means is moved, the trip mechanism is tripped, and the latch means is displaced so as to cause a rapid step-by-step counter-rotation by the sprinkler body back to the extreme other end of the arc. There the interaction of the trigger means with the other sector stop again trips the trip mechanism and reverses the rotation of the sprinkler body back to the desired direction of slow rotation. When it is desired to operate a partial circle sprinkler in a full circle mode of operation, a portion of the trigger means is simply folded out of the way so that the trigger means either does not contact the sector stops or at least does not contact them in such a way as to cause tripping of the trip means. In those instances where the trip mechanism just happens to be set for rotation in the sprinkler body in the direction of fast rotation, the sprinkler in full circle operation will rotate rapidly, thereby preventing the spray from reaching its full potential range. In this instance the user must shut down the fluid source or otherwise stop the initial rotation and then manually reposition the trigger means so that, when the fluid source is brought back up, the sprinkler body rotates in the desired direction of slow rotation. In many instances a novice user will not understand what has happened and will simply consider the sprinkler to be broken. Accordingly, the need remains for an automatic device within the sprinkler which, during full circle operation, automatically corrects the direction of rotation of the sprinkler body should the same prove necessary.

Accordingly, it is an object of the present invention to provide a pulsating sprinkler which utilizes a helical torsion spring having pre-bent ends which are easily engaged with the cooperating parts of the sprinkler during the assembly process without further bending, without the use of tools, and without substantial distortion of the regular helical pattern of the torsion spring.

Another object is to provide such a sprinkler which utilizes a trip spring with prebent ends which are easily engaged with the cooperating parts during the assembly process without further bending and without the use of external fasteners.

A further object is to provide such a sprinkler which employs a ridged bushing member and a pair of plastic sector stops, each sector stop having a single tab by means of which one may rotate the sector stop in either direction.

It is another object to provide such a sprinkler which is equipped with an automatic device which, during full circle operation, automatically corrects the initial direction of rotation of the sprinkler body should the same prove necessary.

SUMMARY OF THE INVENTION

The above and related objects of the present invention are obtained in a sprinkler having at least three aspects. The first aspect resides in a pulsating sprinkler comprising a helical torsion spring, a sprinkler body having a hollow portion adapted to carry a fluid stream, and an impact arm mounted on the sprinkler body for oscillating movement toward and away from an impact limiting position. The impact arm is adapted to move away from the impact limiting position under the influence of the stream and towards the impact limiting position under the influence of the spring, the spring operatively connecting adjacent one end thereof the sprinkler body and adjacent the other end thereof the impact arm. The sprinkler body and impact arm each include lug means, while the spring has ends which reversely bend to form partially open loops engaging the lug means. The loops are disengageable from and re-engageable with the lug means without further opening or closing of the loops and without the use of tools.

In a preferred embodiment of the first aspect of the invention, each of the loop-engaging lug means defines an aperture having a periphery operatively enclosed by the lug means, the tips of the spring ends being removable from and re-insertable into the lug apertures without further bending of the spring ends, whereby the spring ends are disengageable from and re-engageable with the lug means without the use of tools. The spring ends engage the lug means in a manner such that the movement of the impact arm away from the impact limiting position is in the appropriate direction for causing the spring loops to advance so that the portion of the lug means therewithin approaches the reverse bend thereof. The sprinkler body and the impact arm each preferably include a plurality of the lug means, one lug means of each of the plurality of lug means being the loop-engaging or apertured lug means and the others being engaged by the nearest turn of the spring and acting to center the nearest turn about a given axis. One of the lug means is preferably diametrically opposed to the loop-engaging lug means and includes means which cooperate with the loop-engaging lug means to maintain the last half turn of the spring in a given plane, the plane preferably being substantially perpendicular to the given axis.

A second aspect of the present invention is a part circle step-by-step sprinkler comprising a member adapted for connection to a fluid source and having a circumferential portion defining radially outwardly projecting ridges. A sprinkler body is mounted on the member and rotatable relative thereto in either direction, the sprinkler carrying nozzle means. Trip means are disposed on the sprinkler body and adapted to reverse the direction of rotation thereof when tripped, and a pair of manually adjustable sector stops are mounted on a circumferential portion of the member for hindered rotation with respect thereto, each sector stop being adapted upon engagement by the trip means to trip the trip means. Each of the sector stops extends about the member circumferential portion and has a tab projecting radially outwardly therefrom to enable manual movement of the sector stop in either direction, a radially inwardly projecting detent in meshing engagement with the member ridges, and biasing means for urging the sector stop detent against the member circumferential portion.

In a preferred embodiment of the second aspect of the present invention, each sector stop extends about a total circumference of the member circumferential portion, and each sector stop has a single such radially outwardly projecting tab. Each of the sector stops is preferably of a generally annular configuration with an inner ring, an outer ring, and means connecting the inner and outer ring along a narrow sector. The tab, the connecting means and the detent are optimally radially aligned in succession. Each inner ring is resiliently flexible and flattened at a sector diametrically opposite the sector stop detent to bias the detent against the member ridges.

The sprinkler may additionally comprise sealing means disposed intermediate the bottom of the member and the sprinkler body, the sprinkler body having a tapered portion adjacent the top of the member and a radially projecting flange adjacent the bottom of the member. The outer ring of one of the sector stops, preferably the upper sector stop has resiliently flexible lugs extending upwardly from the top thereof into the sprinkler body tapered portion, thereby biasing the member downwardly towards the sprinkler body flange and against the sealing means.

A third aspect of the present invention resides in a pulsating sprinkler comprising a member adapted for connection to a fluid source and a sprinkler body mounted on the member and rotatable relative thereto in either direction, the sprinkler body having a hollow portion adapted to carry a fluid stream. Trip means are disposed on the sprinkler body and adapted to reverse the direction of rotation thereof when tripped. A pair of manually adjustable sector stops are mounted on the member for hindered rotation with respect thereto, each sector stop being adapted upon engagement by the trip means to trip the trip means. The trip means includes means operable during full circle operation of the sprinkler to trip the trip means automatically upon engagement thereof with one of the sector stops when the sprinkler body is rotating in one direction, while permitting full circle rotation thereof in the opposite direction.

In a preferred embodiment of the third aspect, the trip means include a trigger means and is tripped by movement of the trigger means. The trigger means has a body and an extension thereof, the trigger extension being manually movable between a limited sector sprinkler position in which the trigger extension extends into the operative planes of the tabs of both of the sector stops for tripping engagement therewith and a full circle sprinkle position in which the trigger extension is spaced from the operating planes of the tabs of both of the sector stops to preclude tripping engagement therewith. The trigger body is preferably movable between a fast rotation position wherein it extends into the operative planes of the tab of only one of the sector stops for tripping engagement therewith and a slow rotation position wherein it is spaced from the same. When the trigger extension is in the full circle sprinkler position, the trigger body, if not already in the slow rotation position, is automatically re-oriented thereto by engagement with the tab of the one sector stop. More particularly the sector stops are preferably vertically aligned, with the one sector stop being the upper one. When the trigger extension is in the full circle sprinkle position it is disposed above the operative plane of the tabs, and when the trigger body is in the slow rotation position it is functionally disposed above the operative plane of the tab of the one sector stop.

DETAILED DESCRIPTION OF THE PREFERRED EMBODIMENTS

Figure 1:
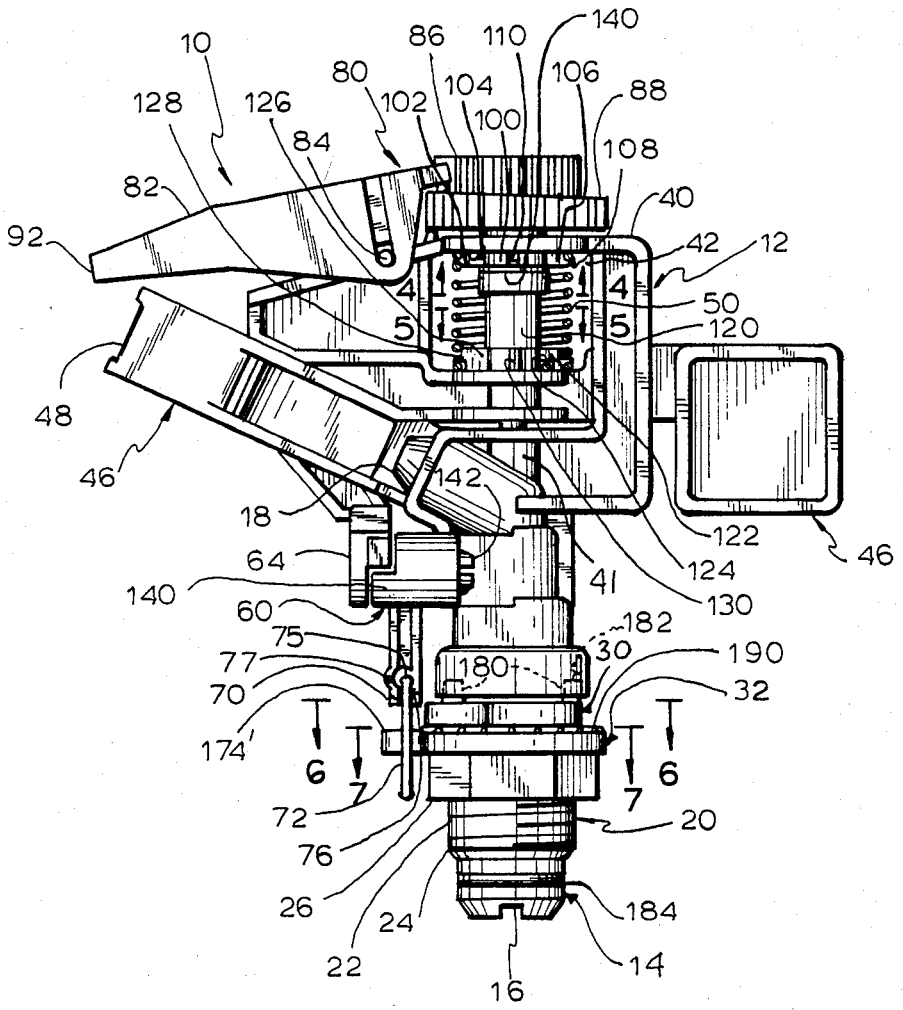
FIG. 1 is a side elevation view of a pulsating sprinkler according to the present invention with the trigger means in its partial circle orientation and the latch means in the fast rotation position.
Figure 2:
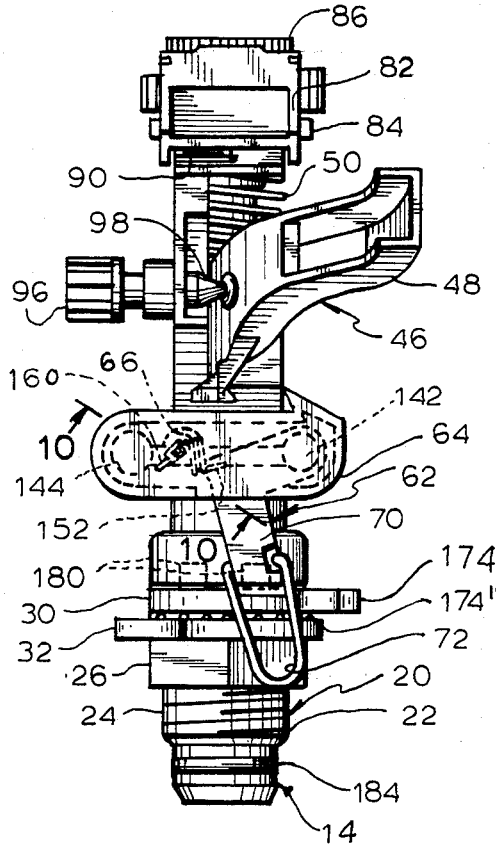
FIG. 2 is a front elevation view of the sprinkler.
Figure 3:
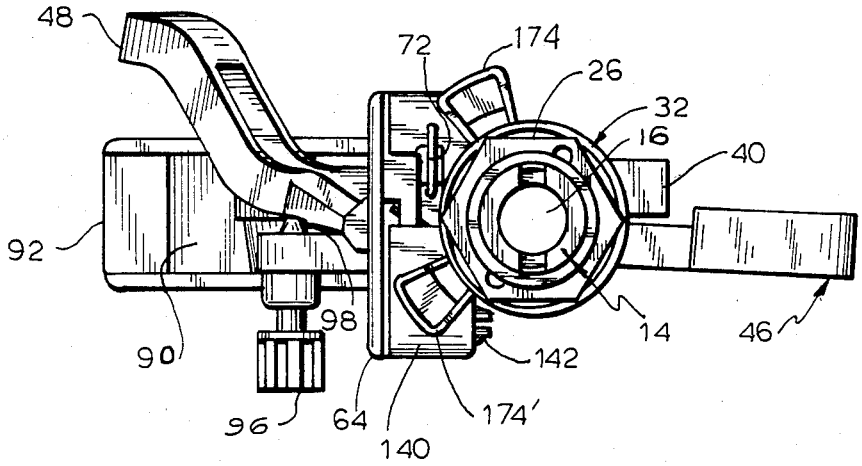
FIG. 3 is a bottom plan view of the sprinkler.

Referring now to the drawing, and in particular to FIGS. 1–3 thereof, therein shown is a part-circle step-by-step pulsating sprinkler, generally indicated by the numeral 10, which embodies the principles of the present invention. With regard to its conventional aspects, the sprinkler 10 includes a sprinkler body, generally designated by the numeral 12, and a tubular member, generally designated by the numeral 14, the upper portion of the tubular member 14 being in threaded engagement with the lower portion of the sprinkler body 12. A fluid passage 16 begins at the lower end of the tubular member 14 and extends upwardly therethrough and through the sprinkler body 12 along a vertical axis and then upwardly and outwardly through an outlet nozzle 18 of the sprinkler body.

A sleeve assembly, generally designated by the numeral 20, is mounted for rotational movement about the vertical axis of the tubular member 14. The sleeve assembly 20 includes a bushing member 22 having an externally threaded lower portion 24, an intermediate portion 26 of nut-like appearance, and an upper portion 28 having radially outwardly projecting vertically-extending ridges 29 thereon (see FIGS. 6–7). The sleeve assembly 20 also includes a pair of vertically aligned upper and lower sector stops generally designated by the numerals 30 and 32, respectively. The externally threaded lower portion 24 of the bushing member 22 is adapted for connection with a fluid source such as an internally threaded sprinkler base (not shown). When the bushing member 22 and the fluid source are in threaded engagement, the sprinkler body 12 is supported by the sleeve assembly 20 for rotational movement about a vertical axis. When a fluid source delivers water under pressure to the inlet of the passageway 16, the water under pressure will flow upwardly through the sprinkler body 12 and then upwardly and outwardly through the outlet nozzle 18. It will be noted that the outlet nozzle 18 has a central longitudinal axis which passes through the axis of rotation of the sprinkler body 12, the axis of rotation of the sprinkler body and the central longitudinal axis of the outlet intersecting at an angle of approximately 65 degrees.

Figure 4:
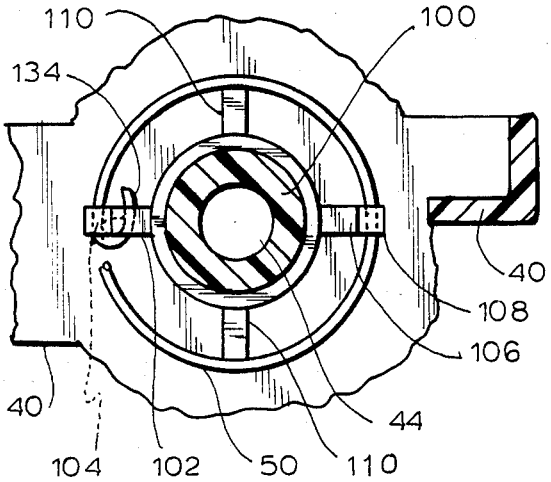
FIG. 4 is a fragmentary bottom plan view, partially in cross section and to an enlarged scale, taken along the line 4—4 of FIG. 1 and showing the engagement of the helical torsion spring and the sprinkler body.
Figure 5:
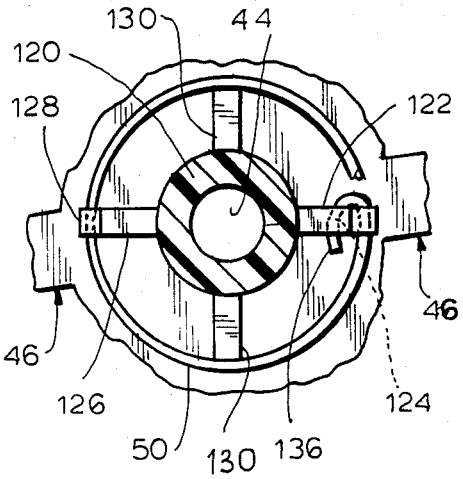
FIG. 5 is a fragmentary top plan view, partially in cross section and to an enlarged scale, taken along the line 5—5 of FIG. 1 and showing the engagement of the helical torsion spring and the impact arm.

The upper portion 40 of the sprinkler body 12 defines an opening 42 formed therein. A shaft 44 (see FIGS. 4–5), having an axis aligned with the vertical axis of rotation of the sprinkler body 12, is mounted in the sprinkler body upper portion 40 so as to extend upwardly through the opening 42 and be anchored at the middle portion 41 of the sprinkler body 12. Mounted on the shaft 44 for oscillatory pivotal movement is an impact arm generally designated by the numeral 46. At one end of the impact arm 46 is a drive spoon 48. The impact arm 46 is normally biased into an impact limiting position as shown in FIGS. 1–3 wherein the portions of the impact arm 46 adjacent the shaft 44 engage the upper portion 40 of the sprinkler body 12 on opposite sides of the opening 42. The bias is provided by a helical torsion spring 50 surrounding a middle portion the shaft 44 and having one end secured to the sprinkler body upper portion 40 and the other end thereof secured to the impact arm 46.

The drive spoon 48 is adapted to be engaged by the fluid stream when it is in its impact limiting position and to impart a rotary movement to the impact arm 46, by virtue of the reaction of the water on the spoon, in a direction to move the spoon away from the stream. As the arm rotates in a direction to move the spoon away from the stream, spring 50 normally retards its movement until it is completely stopped and resiliently biased thereby to move in the opposite direction, back to the impact limiting position. In this way, as the arm 46 rotates under the action of the spring 50 and moves into its impact limiting position, the sprinkler body upper portion 40 is impacted, causing the sprinkler body 12 to move about its vertical pivotal axis. Thus, in accordance with usual practice, the impact arm 46 and its drive spoon 48 will normally effect a step-by-step slow rotational movement of the sprinkler body in one direction.

In order to minimize or preclude backsplash or secondary spray, the drive spoon 48 may be constructed according to anti-backlash principles of the type well known in the art and exemplified by U.S. Pat. No. 3,022,012; U.S. Pat. No. 3,977,610 and U.S. Pat. No. 4,164,324.

The sprinkler 10 is provided with a reversing or trip mechanism, generally indicated by the numeral 60, which is adapted to cooperate with the impact arm 46 and sector stops 30, 32. The trip means 60 comprises trigger means generally designated by the numeral 62, latch means 64 for engaging the impact arm 46 before it has an opportunity to substantially wind up the helical torsion spring 50 by substantial movement away from the impact limiting position, and a trip spring generally designated by the numeral 66 and connecting the trigger means 62 and latch means 64 so that a predetermined movement of the trigger means 62 results in a predetermined movement or tripping of the latch means 64. The trigger means 62 is pivotally mounted to a trip box 140 of the sprinkler body by means of pivot member 142, while the latch means 64 is pivotally mounted to the trip box 140 by means of a pivotal member 144. Each of the pivotal members 142, 144 is resiliently compressible at its free end to enable its passage through a suitably provided respective bearing 146 in the trip box 140 (see FIG. 11) and its retention there against accidental displacement.

The trigger means 62 comprises a ridged body portion 70 and an extension 72 thereof. The trigger extension 72 is pivotally mounted through an aperture 75 passing through the trigger body 70 and manually movable between a limited sector sprinkle position in which the trigger extension 72 is disposed in a groove 76 of the trigger body 70 and longitudinally aligned with the trigger body 70 so as to extend into the operative horizontal planes of both sector stops 30 and 32 for tripping engagement therewith and a full circle sprinkle position in which the trigger extension 72 is disposed in a groove 77 of the trigger body 70 and is folded into a substantially perpendicular orientation relative to the trigger body 70 so that the trigger extension 72 is spaced above the operative planes of both of the sector stops 30, 32 to preclude tripping engagement therewith. When the trigger extension is in the limited sector sprinkle position and the sprinkler body 12 reaches a first predetermined position as determined by the position of one of the adjustable sector stops 30, 32, the trip mechanism 60 is moved into a second position which has the effect of causing the latch means 64 to pivot upwardly (see FIGS. 1–3) so that it intercepts and limits the outward movement of the impact arm 46, thereby to effect a rapid step-by-step rotary movement of the sprinkler body in the opposite direction until the latter reaches a second predetermined position of rotational movement determined by the position of the other sector stop 32, 30, whereat the trip mechanism 60 is moved back into its other (first) operating position with the latch means 64 pivoted downwardly to a non-intercepting orientation.

The sprinkler optionally further includes a conventional deflector mechanism, generally designated by the numeral 80, comprising a deflector block 82 pivotally mounted on the sprinkler body upper portion 40 at 84. A knurled deflector knob 86 has a sloping outer flange 88 which acts on the engaged end of the deflector block 82 to cause the free end 92 thereof to move into or away from the fluid stream emerging directly from the nozzle 18 when it bypasses the spoon 48. Deflector spring 90 (see FIG. 2) biases the deflector block 82 to a non-deflecting orientation, but, when deflector knob 86 is rotated so that the high portion of the flange 88 is engaging the abutting portion of the deflector block 82, the deflector block free end 92 blocks passage of the upper portions of the fluid stream emerging from the nozzle 18.

The sprinkler optionally further includes a conventional diffuser screw 96 passing through the upper portion 40 of the sprinkler body 12 in an adjustable manner so that all or a portion of the tip 98 thereof may be manually disposed in the fluid stream emerging from the nozzle 18 so as to cause that stream to spread out and diffuse.

As the conventional aspects of the present invention are well known to those skilled in the art, they need not be further set forth herein.

Turning now to the novel aspects of the present invention, and referring to FIGS. 1, 4–5 and 11 in particular, one novel aspect resides in the manner in which the helical torsion spring 50 is secured at its upper end to the sprinkler body upper portion 40 and at its lower end to the impact arm 46.

The sprinkler body upper portion 40 defines a downwardly extending collar 100 disposed about the upper end of shaft 44. Extending radially outwardly from the top of collar 100 are four lugs, one lug 102 defining and totally surrounding an aperture 104 extending horizontally therethrough, a diametrically opposed retaining lug 106 having a radially outwardly extending lip 108 on the outer surface thereof, and two diametrically opposed centering lugs 110 disposed in a plane perpendicular to the plane containing the lugs 102, 106. The impact arm 46 also defines a collar 120 disposed about the lower end of the shaft 44. Extending radially outwardly from the bottom of collar 120 are four lugs, one lug 122 defining and totally surrounding an aperture 124 therethrough, a diametrically opposed retaining lug 126 having a radially outwardly extending lip 128 on the outer surface thereof, and two diametrically opposed centering lugs 130 disposed in a plane perpendicular to the plane containing lugs 122, 126.

The helical torsion spring 50 is disposed about the shaft 44 and collars 100, 120 and has an upper end 134 and a lower end 136. Each spring end 134, 136 is reversely bent to form a partially open loop engaging an associated apertured lug 102, 122, respectively. The spring ends 134, 136 are reversely bent to form the appropriate loops during manufacture of the spring 50 or, at least, at a time prior to assembly of the spring 50 with its cooperating parts during the sprinkler assembly process. The partially opened loops formed by the spring end 134, 136 are thus easily engageable with the apertured lugs 102, 122, respectively, by simple insertion of the free spring ends 134, 136 into the apertures 104, 124, respectively. No bending of the spring ends 134, 136 or closing of the loops is required during the assembly process as the natural biasing action of the spring 50 suffices to maintain the portions of the apertured lugs 102, 122 within the loops disposed well into the reverse bend portions of the loops. As the impact arm 46 is moved away from its impact limiting position, the portions of the apertured lug means 102, 122 within the loops tend to be advanced towards the reverse bend of the loops. As no bending of the spring ends 134, 136 is required during the assembly process, the subjective variations in the degree of opening or closing of the loops which would occur with particular assembly workers is avoided. Furthermore, the loops remain disengageable from and re-engageable with the apertured lug means 102, 122 without further opening or closing of the loops and without the use of tools, thereby facilitating replacement thereof.

The retaining lug 106 and the centering lugs 110 each engage the nearest turn of the spring 50 adjacent the spring end 134 and act to center that nearest turn about the collar 100 and hence the upper end of shaft 44. The retaining lug 126 and the centering lugs 130 each perform the same function with respect to the nearest turn of the spring 50 adjacent the spring end 136, centering the last turn about the collar 120 and hence the lower end of shaft 44. The upwardly tapered, radially outwardly extending lip 108 of the retaining lug 106 (diametrically opposed to the apertured lug 102) is, however, also adapted to have the portion of the spring 50 about a half turn from the loop 134 slipped thereover so that the lip 108 in cooperation with apertured lug 102 can maintain the last half turn flat (i.e., perpendicular to the axis of the shaft 44) against the inner surface of the sprinkler body of the upper portion 40. This retaining function of the lip 108 assists in retaining the engagement between reversely bent end 134 and the apertured lug 102 while introducing only an inconsequential deviation from the uniformity of the helical pattern. Lip 128 of the retaining lug 126 performs substantially the same function as the lip 108 of the retaining lug 106, maintaining in cooperation with apertured lug 122 the last half turn of the spring 50 adjacent the loop 136 in a substantially horizontal plane to enhance the engagement of the reversely bent end 136 and the apertured lug 122.

The spring 50 serves the further purpose of biasing the impact arm 46 upwardly against a washer 140 about shaft 44 intermediate collars 100, 120 (see FIG. 1) so as to facilitate rotation of the collar 120 of impact arm 46 with respect to the sprinkler body upper portion 40.

Figure 10:
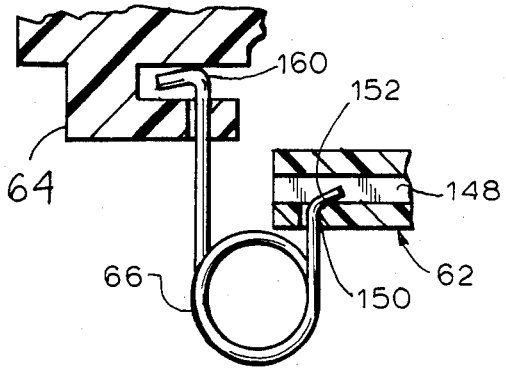
FIG. 10 is a sectional view, to an enlarged scale, taken along the line 10—10 of FIG. 2 and showing the engagement of the trip spring with its cooperating parts.
Figure 11:
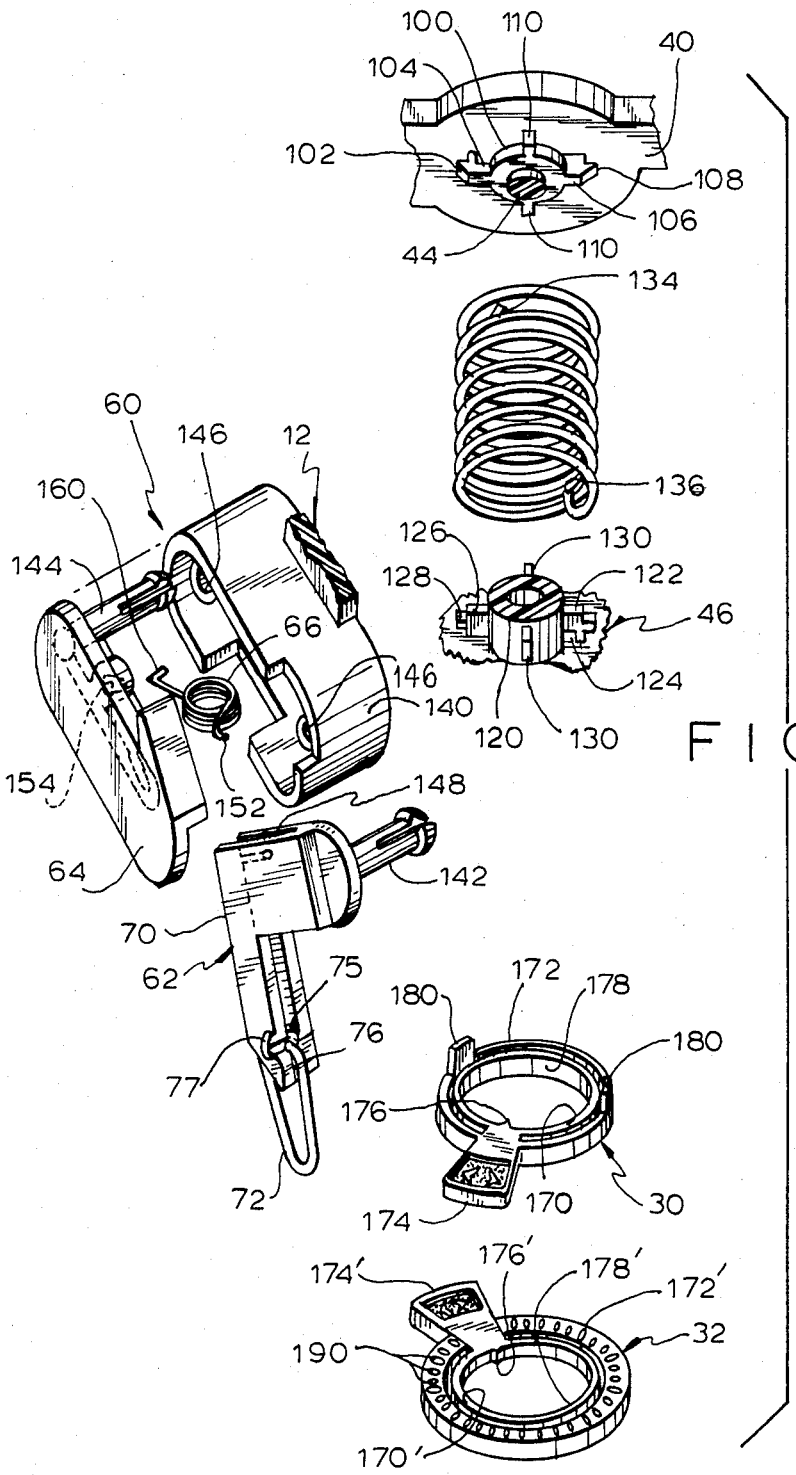
FIG. 11 is an exploded isometric view of some of the main novel components of the present invention.

Referring now to FIGS. 2 and 10–11 in particular, therein illustrated is a related novel aspect of the present invention concerning the use of a trip spring having pre-bent ends not requiring bending during the assembly process. In accordance with this novel aspect, a portion of the trigger means 62 within trip box 140 is provided with a slot 148 having a recess 150 in the side wall thereof, thereby enabling a pre-bent spring end 152 of spring 66 to be removably lodged in the slot 148 without any further bending of the spring end 152. A portion of the latch means 64 within trip box 140 is provided with a recess 154 in the side wall thereof, thereby enabling a pre-bent end 160 of spring 66 to be removably lodged in the recess 154 without any direct further bending of the spring end 160. Thus the components of the trip means 60 are assembled in the trip box 140 without any further bending of the pre-bent ends 152, 160 of spring 66 so that the inevitable variations in the bending of the spring ends 152, 160 from one assembler to another, and even by one assembler at different times, is avoided and the spring 66 may be disassembled from the trigger means 62 and latch means 64 and reassembled therewith without further bending or unbending of the spring ends 152, 160.

Figure 6:
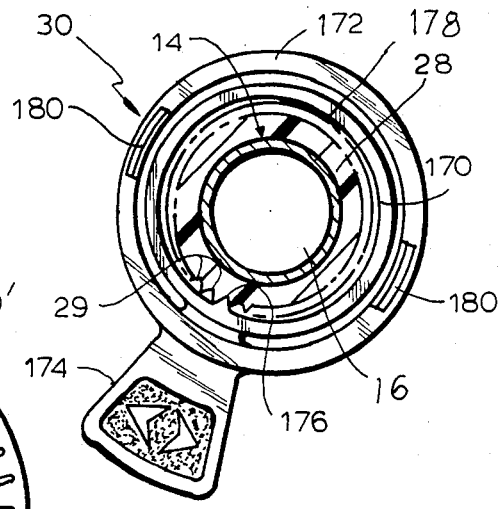
FIG. 6 is a top plan view, partially in cross section, of the upper sector stop and the bushing member engaged thereby, taken along the line 6—6 of FIG. 1.
Figure 7:
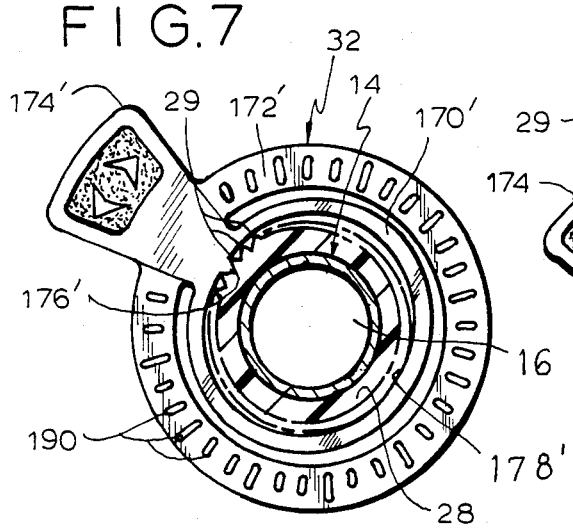
FIG. 7 is a top plan view, partially in cross section, of the lower sector stop and the bushing engaged thereby, taken along the line 7—7 of FIG. 1.

Referring now to FIGS. 1–3, 6–7 and 11 in particular, another novel aspect of the present invention concerns the sector stops 30, 32 which are mounted on the bushing member 22 and, more particularly, the upper portion 28 having radially outwardly extending ridges 29 (see FIGS. 6–7). Each of the sector stops 30, 32 is of annular design so that it totally surrounds an upper bushing portion circumference and comprises an inner ring 170, 170' and an outer ring 172, 172', respectively. A single radially outwardly projecting solid tab 174, 174' constitutes the sole connection between the inner ring 170, 170' and the outer ring 172, 172' of each sector stop 30, 32, respectively. Each tab 174, 174' extends radially outwardly beyond the outer ring 172, 172' for manual grasping and intereaction with trigger means 62. A detent 176, 176' is radially aligned with the tab 174, 174' and extends radially inward beyond the inner surface of the inner ring 170, 170', respectively.

The tabs 174, 174' are stiff due to their width in the horizontal plane, and the outer ring 172' of the lower and larger sector stop 32 is also stiff due to its radial thickness. In contrast, the inner rings 170, 170' are resiliently flexible due to their radial thinness. They also depart from true circles to a substantial degree, an arc 178, 178' of each inner ring 170, 170', diametrically opposite the tabs 174, 174', being flattened in order to bias the detents 176, 176' against the ridges 29 of the bushing member upper portion 28. The biasing action provided by the inner rings 170, 170' is easily overcome by even light manual pressure at the tabs 174, 174' tending to rotate the sector stops, with the action of the detents 176, 176' ratcheting over the ridges 29 providing a clicking sound to give an aural indication of how far the sector stop has been rotated from its original position. On the other hand, the biasing action is sufficiently strong to prevent accidental displacement of the sector stops by either incidental vibratory activity or the abutting action of the trigger 62. The trigger 62, it is noted, abuts the tabs 174, 174' close to the base thereof and thus exerts a rotary force which acts through only a small lever arm relative to the effective lever arm when the user rotates the extending free end of the tabs 174, 174'.

The thin outer ring 172 of the smaller upper sector stop 30 is resiliently flexible as are the two diametrically opposed fingers 180 projecting upwardly from its upper surface. The fingers 180 engage with the upwardly and slightly inwardly inner tapering surface 182 of the sprinkler body 12 so as to bias the bushing member 20 downwardly. As a result, the bottom of the bushing member 20 squeezes the seal washer 184 between the base of the bushing member 20 and tubular member 14, preventing dirt from getting into the seal and wearing surfaces of the seal washer. This obviates the need for a conventional compression spring which is sometimes employed in the prior art to maintain a downward pressure on the sleeve assembly 20 for the same purpose.

The tabs 174, 174' are provided with indicia indicating the permissible directions of rotation (either direction for either tab), and the upper surface of the outer ring 172' of lower tab 32 has a pattern of radially extending ridges 190 thereon. These ridges 190 provide an indication of the arc which will be covered by the spray being emitted from the sprinkler during limited circle operation (the ridges 190 being spaced approximately 10 degrees apart).

Figure 8:
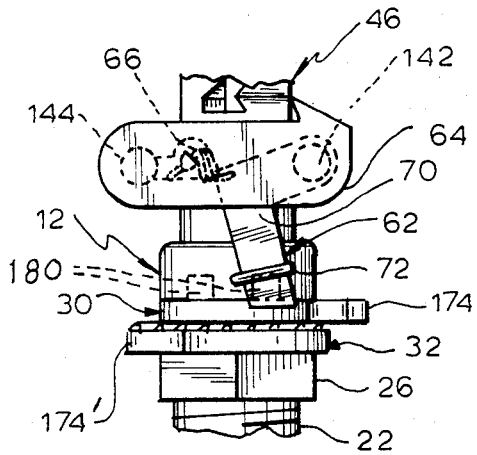
FIG. 8 is a fragmentary front elevation view of the sprinkler showing the trigger extension in its full circle orientation and the trigger body in the fast rotation position.
Figure 9:
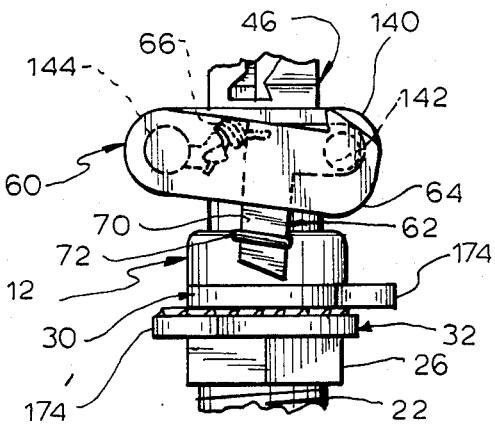
FIG. 9 is a view similar to FIG. 8, but with the trigger body in the slow rotation position.

Referring now to FIGS. 1–2 and 8–9 in particular, a further aspect of the invention resides in the automatic correction of the direction of rotation during full circle operation of the sprinkler. When the sprinkler 10 is being used in partial circle or limited sector operation, as shown in FIGS. 1–2, the trigger extension 72 is axially aligned with and extends downwardly from the trigger body 70, into the planes of both of the sector stop tabs 174, 174', so that the trigger body 70 is moved from one extreme position to another extreme position as the trigger extension 72 abuts and is moved by the sector stop tabs 174, 174'. When the trigger means 62 is in its normal or slow rotation position, as illustrated in FIG. 9, the latch means 64 does not engage the impact arm 46 so that the impact arm 46 is capable of tensioning the helical torsion spring 50 and the slow step-by-step normal rotation of the sprinkler body 12 (in a clockwise direction if the sprinkler is viewed from the top of FIG. 1) permitting the greatest throwing power for the spray results from the torsion spring 50 returning the impact arm 46 to its impact limiting position. On the other hand, when the trigger means 62 has been switched by one of the sector stops 174, 174' to the fast rotation orientation, as shown in FIGS. 1–3 and 8, the latch means 64 is raised to engage the impact arm 46 while it is still in the path of the stream, so that the impact of the emerging stream on the impact arm 46 causes the sprinkler body 12 to undergo a rapid step-by-step rotation in a returning direction, away from the impact limiting position and back to its original position, whereupon the trigger extension 72 abuts and is moved by a sector stop tab 174', 174, thereby tripping the trip means 60 and returning the latch means 64 to its depressed non-engaging position. The speed of return rotation is so rapid that a severely reduced throw of the emerging spray is produced.

When it is desired to operate the partial circle sprinkler in a full circle mode of operation, the user has only to reposition or pivot the trigger extension 72 so that instead of the trigger extension crossing the plane of the sector stops 30, 32 as shown in FIGS. 1–3, it is spaced thereabove, as illustrated in FIGS. 8–9. As shown in FIGS. 8–9, when the trigger extension 72 is in its limited sector sprinkler position, so that it extends perpendicular to the axis of the trigger body 70, the effective length 70 of the trigger means 62 is short. And, when the trigger body 70 is in the slow rotation position (with the latch means 64 in its non-engaging orientation), as shown in FIG. 9, the sprinkler body 12 rotates slowly in the desired direction of rotation with the trigger means 62 not being operatively engaged by the upper sector stop tab 174.

While normally the trigger 62 will be in the slow rotation position when the fluid source for the sprinkler is turned on, it must be appreciated that on occasion this will not be so. For example, in moving the trigger extension 72 from its limited sector sprinkle position (wherein its axis is aligned with that of the trigger body 70) into the full circle sprinkle position (wherein its axis is perpendicular to that of the trigger body 70), the user may accidentally move the trigger body 70 from the slow rotation position (wherein the latch means 64 is in a non-engaging orientation) into a fast rotation position (wherein the latch means 64 is in an engaging orientation). If this has occurred, once the fluid source for the sprinkler is turned on the sprinkler body will rotate rapidly in the wrong direction of rotation. This cannot safely be corrected manually without first turning off the fluid source and, after the manual correction, turning it back on.

According to the present invention, however, as shown in FIG. 8, the trigger body 70 itself extends sufficiently into the plane of the upper sector stop tab 174 that, before even a single full rotation in the wrong direction can be completed, the tab 174 will operatively engage the trigger body 70 to trip the trip means 60, thereby reversing the direction of rotation and causing the sprinkler to operate in a full circle mode slowly in the proper direction of rotation. It will be appreciated that, as for any given trip means 60 a certain minimum level of movement of the trigger body 70 is required in order to trip the latch means 64, it is not enough for the trigger body 70 merely to extend into the plane of the upper sector stop tab 174; it must extend sufficiently into the plane to cause operative engagement between the tab 174 and the trigger body 70. (For the purposes of this application, an "operative engagement" is an engagement sufficient to trip the trip means 60 and cause a change in the orientation of latch means 64.) Thus, when the trigger extension 72 is in the full circle sprinkle position, the trigger body 70 permits full circle rotation of the sprinkler body in the desired direction of slow rotation while automatically limiting and correcting without human intervention any initial rotation thereof in the undesired direction of fast rotation.

Operation of the sprinkler is essentially conventional in nature, with the threaded end of the bushing member 20 being operatively connected to a fluid source, normally through a sprinkler base, the knob 86 being rotated to provide the desired level of deflection by the deflector arm 82, and the diffusion screw 96 being rotated to provide the desired degree of diffusion of the emitted spray. If the sprinkler is to be operated in a full circle mode, the trigger extension 72 is lifted until it resiliently snaps into the groove 77 and extends above the plane of the sector stops 30, 32. If the sprinkler is to be operated in a partial circle mode, the trigger extension 72 is lowered until it is aligned with the trigger body 70 and resiliently snaps into the groove 76. The only real difference in the mode of operation by the user is that each sector stop 30, 32 can be adjusted simply by grasping the appropriate tab 174, 174' and rotating that tab in either direction until the two sector stop tabs define the desired arc to be watered.

The sprinkler is preferably formed entirely of plastic, with the exception of the various springs (helical torsion spring 50, trip spring 66 and deflection spring 90), the shaft 44, the seal washer 184 and the trigger extension 72. The principles of the present invention are, however, also directly applicable to a sprinkler formed primarily of metal.

To summarize, the present invention provides a pulsating sprinkler incorporating helical torsion and trip springs with pre-bent ends, facilitating the assembly process, avoiding the damage to springs which may occur when they are bent as part of the assembly process, and facilitating spring replacement. Also, the sector stops are easily rotated in either direction using a single tab and interact with the sprinkler body to maintain a squeezing action on the seal washer at the base of the sprinkler, thereby to preclude the entry of dirt. Furthermore, the sprinkler provides fully automatic correction of the direction of rotation of the sprinkler body during full circle operation.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

I claim:

1. In a pulsating sprinkler comprising (A) a helical torsion spring having an axis;

(B) a sprinkler body having a hollow portion adapted to carry a fluid stream; and (C) an impact arm mounted on said sprinkler body for oscillating movement toward and away from an impact limiting position, said impact arm being adapted to move away from said impact limiting position under the influence of the stream and toward said impact limiting position under the influence of said spring, said spring operatively connecting adjacent one end thereof said sprinkler body and adjacent the other end thereof said impact arm;

the improvement wherein said sprinkler body and said impact arm each include lug means extending generally toward and spaced from one another in the direction of the axis of said spring, having a surface laterally exposed substantially at right angles to the axis of said spring and, spaced therefrom, an aperture operatively closed in the direction of the axis of said spring toward the other of said lugs, and said spring has ends which are reversely bent to form incomplete loops a first portion of which engages said surface of said lug means and a second portion of which enters said aperture, said loops being disengageable from and re-engageable with said lug means, without further opening or closing of said loops and without the use of tools.

2. The sprinkler of claim 1 in which said lug means comprises a part protruding laterally from the upper portion of said laterally exposed surface, beneath which part said first portion of said spring is received.

3. The sprinkler of claim 1 comprising a member adapted for connection to a fluid source and having a circumferential portion defining radially outwardly projecting ridges; said sprinkler body being mounted on said member and rotatable relative thereto in either direction; trip means disposed on said sprinkler body and adapted to reverse the direction of rotation thereof when tripped; and a pair of manually adjustable sector stops mounted on a circumferential portion of said member for hindered rotation with respect thereto, each said sector stop being adapted upon engagement by said trip means to trip said trip means; each said sector stop extending about said member circumferential portion and having a tab projecting radially outwardly therefrom to enable manual movement of said sector stop in either direction, a resiliently flexible structural portion engaging said member, said stop carrying a radially inwardly projecting detent, said portion biasing said detent radially inwardly into meshing engagement with said member ridges, said tab and detent both lying in the plane of said sector stop, whereby said sector stops may be mounted on said member circumferential portion without the need for any axial biasing.

4. In a step-by-step sprinkler capable of part-circle operation comprising (A) a member adapted for connection to a fluid source and having a circumferential portion defining radially outwardly projecting ridges;

(B) a sprinkler body mounted on said member and rotatable relative thereto in either direction, said sprinkler body carrying nozzle means;

(C) trip means disposed on said sprinkler body and adapted to reverse the direction of rotation thereof when tripped; and (D) a pair of manually adjustable sector stops mounted on a circumferential portion of said member for hindered rotation with respect thereto, each said sector stop being adapted upon engagement by said trip means to trip said trip means;

the improvement wherein each of said sector stops extends about said member circumferential portion, has a tab projecting radially outwardly therefrom to enable manual movement of said sector stop in either direction, said stop comprising a resiliently flexible structural portion engaging said member, said stop carrying a radially inwardly projecting detent, said portion biasing said detent radially inwardly into meshing engagement with said member ridges, said tab and detent both lying in the plane of said sector stop, whereby said sector stops may be mounted on said member circumferential portion without the need for any axial biasing.

5. The sprinkler of claim 4 wherein each of said sector stops is of generally annular configuration, with an inner ring, an outer ring and means connecting said inner and outer rings along a narrow sector, said tab, said connecting means and said detent being radially aligned in succession.

6. The sprinkler of claim 5 wherein said inner ring is resiliently flexible and flattened at a sector diametrically opposite said sector stop detent to bias said detent against said member ridges.

7. The sprinkler of claim 4 further comprising sealing means disposed adjacent the bottom of said member and below said sector stops, said sprinkler body comprising a portion above said sector stops defining an inner wall tapered upwardly and inwardly, one of said sector stops having a laterally resiliently flexible finger extending up therefrom into laterally resilient engagement with said tapered inner wall, whereby said engagement biases said sector stop downwardly into operative engagement with said sealing means.

* * * * *